US007044343B2

(12) United States Patent
Anue

(10) Patent No.: US 7,044,343 B2
(45) Date of Patent: May 16, 2006

(54) GRAVITY FLOW WATER FILTRATION BACKPACK

(76) Inventor: Robert Anue, 24010 Summit Rd., Los Gatos, CA (US) 95033

( * ) Notice: Subject to any disclaimer, the term of this patent is extended or adjusted under 35 U.S.C. 154(b) by 388 days.

(21) Appl. No.: 10/690,331

(22) Filed: Oct. 21, 2003

(65) Prior Publication Data

US 2005/0082320 A1 Apr. 21, 2005

(51) Int. Cl.
*A45F 3/04* (2006.01)
*A45F 3/16* (2006.01)
*C02F 9/00* (2006.01)

(52) U.S. Cl. ..... 224/148.5; 224/148.1; 224/148.2; 210/257.1

(58) Field of Classification Search ..... 224/148.1, 224/148.2, 148.3, 148.4, 148.5, 148.6, 148.7; 210/241, 282, 257.1
See application file for complete search history.

(56) References Cited

U.S. PATENT DOCUMENTS 3,462,361 A * 8/1969 Gajewski et al. ..... 604/7
3,715,035 A * 2/1973 Teeple, Jr. et al. ..... 210/249
4,277,333 A * 7/1981 Coppola ..... 210/136
4,419,235 A * 12/1983 Sway ..... 210/282
4,816,149 A * 3/1989 Wekell ..... 210/257.2
5,322,625 A * 6/1994 Rise ..... 210/238
5,362,385 A * 11/1994 Klegerman et al. ..... 210/136
5,562,824 A 10/1996 Magnusson ..... 210/266
5,569,374 A * 10/1996 Williams ..... 210/136
5,816,457 A 10/1998 Croft ..... 224/148.2
5,975,387 A 11/1999 Gleason et al. ..... 224/148.3
6,245,228 B1 * 6/2001 Kelada ..... 210/206
6,344,146 B1 * 2/2002 Moorehead et al. ..... 210/668
6,454,941 B1 9/2002 Cutler et al. ..... 210/266
6,536,637 B1 3/2003 McLaughlin ..... 224/148.3
6,887,379 B1 * 5/2005 Schiltz ..... 210/266
6,919,025 B1 * 7/2005 Cluff et al. ..... 210/244
2004/0079775 A1 * 4/2004 Choi et al. ..... 224/148.2

FOREIGN PATENT DOCUMENTS

WO WO 2004028290 A1 * 4/2004
WO WO 200009449 A * 2/2005

* cited by examiner

*Primary Examiner*—Nathan J. Newhouse
*Assistant Examiner*—Justin M. Larson
(74) *Attorney, Agent, or Firm*—Law Offices of Terry McHugh

(57) ABSTRACT

A backpack containing a gravity flow water filtration system. The backpack incorporates a compartment at its top to hold a reservoir of untreated water, and a compartment at the bottom to hold a reservoir for filtered water. A tube and filter connect the two compartments, and a drinking tube and mouthpiece allow the user of the backpack to drink filtered water from the filtered water reservoir. In some embodiments, the bottom compartment is accessible from both ends, and can store other items as well.

8 Claims, 3 Drawing Sheets

GRAVITY FLOW WATER FILTRATION BACKPACK

TECHNICAL FIELD

The present invention relates generally to backpacks, and more particularly to backpacks that make provisions for carrying water.

BACKGROUND ART

Carrying a backpack is a convenient method to travel with gear. For many people it is a preferred way to travel into the wilderness to experience the beauty of nature. While traveling this way, it is usually desirable to carry water to drink. This water can be carried in water bottles, or in personal hydration systems. A personal hydration system consists of a water reservoir and a hose that leads to a mouthpiece that is used by a person to obtain a drink.

When traveling in areas where pure water is not available, there are two popular choices to obtain pure water. The first is to chemically treat the water. The second method is to filter the water. Portable water filter systems for backpackers are currently available with pumps associated with them. Producing pure water with these pumps requires pumping dirty water through the filter and into a drinking water bottle or personal hydration system. The disadvantage of pumping is that it requires manual effort and time. Chemically treating water has other disadvantages, including managing the treatment chemicals, needing to wait a period of time for the chemical treatment to become effective, and tasting and ingesting the treatment chemicals.

Convenience is an important factor when traveling with a backpack. Needing to take off a backpack to access important items slows down a traveler, and in a subtle way actually reduces the safety of the backpacker. When an item is difficult to access, the user will naturally access that item less frequently. The result of this is that the backpacker will use a part of his safety margin by delaying his use of the item in question. When snacks are difficult to access, the backpacker will wait longer before he eats. When a map is difficult to get to, the backpacker will refer to it less. When rain gear is difficult to reach, the backpacker will hike longer in drizzle before deciding to put on his rain gear. The drinking tube of a personal hydration system makes accessing water in a backpack easy and convenient. It is important that other items in a backpack also be easy and convenient to access as well. These items frequently include sunscreen, snacks, maps, a compass, insect repellant, a hat and rain gear.

Being able to comfortably carry a varying load is also an important feature of a good backpack. At the start of a week long camping trip, a typical backpacker might carry eleven pounds of food, and this food adds to the weight and volume carried in the backpack. Over the course of that camping trip, the food and its associated weight and volume disappear. A good backpack needs to be easy to carry and conform to the body of the person carrying it, and it needs to retain its properties of comfort and function while carrying loads that differ in volume and weight. Backpacks commonly use rigid frames to stabilize the geometry of the shoulder straps and the waist belts. Frames allow a pack to carry full or partially empty loads, while maintaining unchanging geometries of shoulder straps and waist belts. Backpacks also commonly use horizontal straps and lacing to allow the backpack to shrink its volume.

Backpack frames are also important because they provide a rigid structure that allows the weight of the backpack to be shared between the shoulder straps and the waist belts. When the weight is carried on the shoulder straps, the body of the pack is suspended from the attachment areas of the shoulder straps to the pack, typically near the top of the pack. When the weight of the pack is carried by the waist belt, the body of the pack is lifted from the attachment area of the waist belt to the pack, typically near the bottom of the pack. A rigid, or nearly rigid, connection between the shoulder straps and the waist belts is essential to allow the shoulder straps and waist belts to share the load of the backpack.

SUMMARY OF THE INVENTION

The present invention is a backpack incorporating a gravity flow water filtration system. The advantage of the invention is that it provides filtered water for a person carrying a backpack, without requiring the person to spend time and manual effort to pump it. The reservoir for filtered water is a transverse compartment at or near the bottom of the pack. This compartment also serves as a convenient storage place for frequently used items, because it can be accessed while wearing the pack. The pack design also incorporates a lacing system, a strap system, or the like that allows the volume of the pack to vary without changing the vertical dimension of the pack.

DETAILED DESCRIPTION AND BEST MODE OF THE INVENTION

The present invention is a backpack incorporating a gravity flow water filtration system. The advantage of the invention is that it provides filtered water for a person carrying a backpack, without requiring the person to spend time and manual effort to pump it.

Gravity feed water filtration is achieved in the backpack by incorporating two water reservoirs, one at the top of the pack and the other at the bottom. The top water reservoir holds untreated water, and the bottom reservoir holds filtered water. The water from the top reservoir passes through a tube and a filter to fill the bottom water reservoir with filtered water. A tube and a mouthpiece can be additionally connected to the bottom reservoir, so as to provide the user with the functionality of a personal hydration system.

The water reservoir at the bottom of the backpack is located in a transverse compartment that extends from one side of the backpack to the other. This bottom compartment can be accessed while the backpack is being worn, by the person wearing it. Reaching into this compartment is as easy and natural as the motion of touching one's hands behind one's back. Because of its size and accessibility, the bottom compartment also serves as a storage compartment for frequently used items such as a map, a hat, rain gear, snacks and sunscreen. This is a desirable feature because it gives the user of the backpack convenient access to a large volume of gear, without the need to take off the backpack or even stop walking. An elastic opening to the compartment is an important feature that makes this possible. The user's hand can find the elastic opening by touch, and then stretch it and reach into it with one motion.

The backpack has been designed to maintain a fixed height while carrying loads with varying volumes. This has the advantage of providing a stable and fixed separation between the top untreated water reservoir, and the bottom filtered water reservoir. It also has the advantage of making the vertical separation between the shoulder straps and the waist straps stable. The backpack incorporates a strap system, a lacing system, or a similar system that allows the backpack to shrink and expand in the horizontal dimension.

The preferred embodiment of the invention does not incorporate an internal frame, as a method to achieve weight savings. In this configuration, the rigid connection between the shoulder straps and the waist belt of the backpack is achieved by having the body of the backpack tightly filled. In this way, the whole pack becomes a semi-rigid structure, which allows the shoulder straps and waist belt to share the load of the pack. The lacing system is the mechanism that permits the pack to be loaded with different volumes of gear, and to achieve a tight compression of that gear into a shape with a fixed height.

Figure 1:
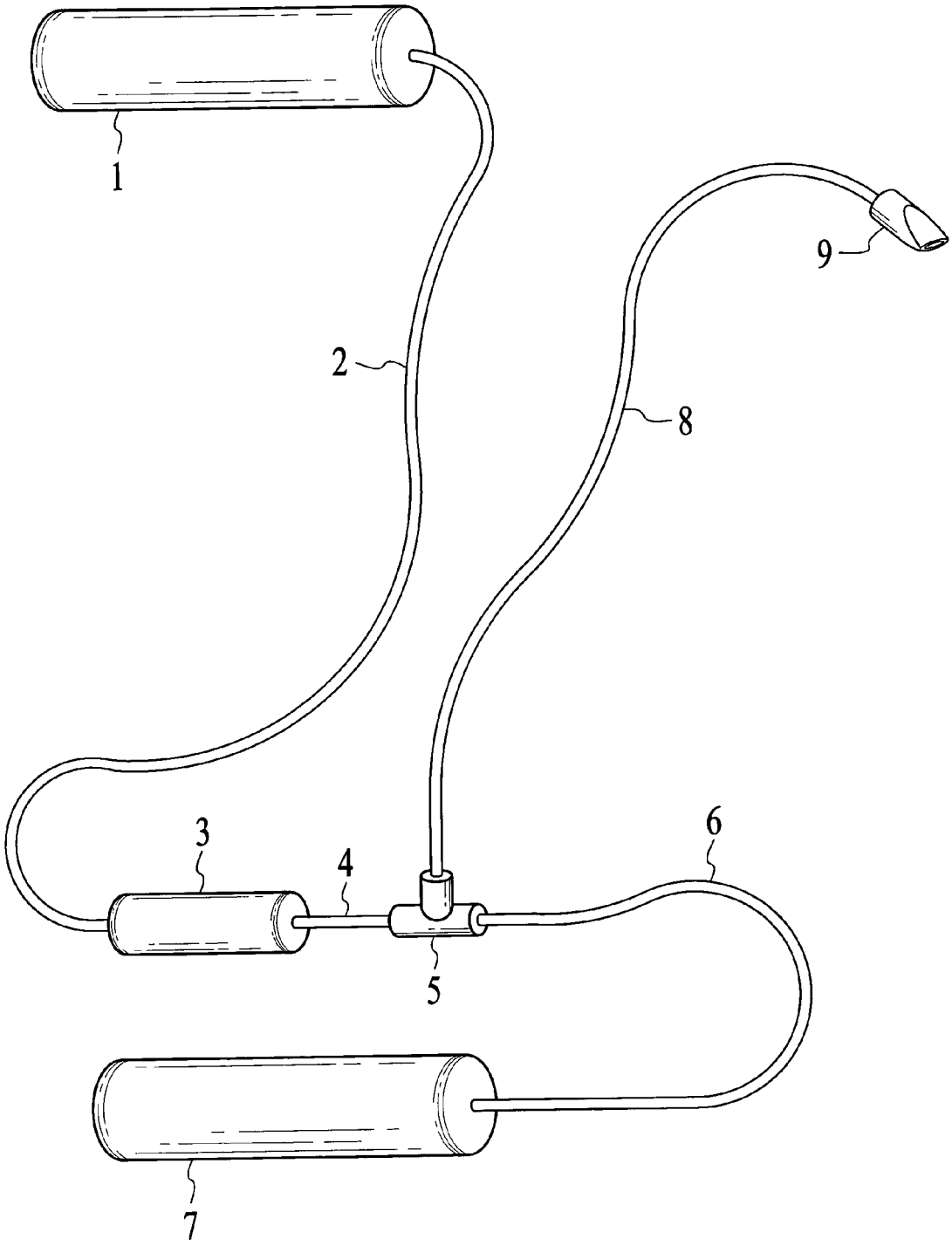
FIG. 1 is a diagram of a gravity flow water filtration system with a drinking tube.

FIG. 1 depicts a gravity flow water filtration system incorporating a drinking tube and mouthpiece. The top reservoir 1 holds untreated water. A tube 2 connects the top reservoir 1 to a filter 3. The outlet of the filter goes through tube 4 to Tee connection 5. A tube 6 connects the Tee 5 with water reservoir 7. A drinking tube 8 connects the Tee 5 to mouthpiece 9.

To operate this gravity flow water filtration system, untreated water is put into reservoir 1. With a low resistance filter, a vertical separation of sixteen inches between reservoir 1 and reservoir 6 provides enough water pressure to cause water to flow through filter 3 and into reservoir 7. This vertical distance of separation is achievable within the vertical dimension of a backpack. Tee 5 allows a drinking tube 8 and mouthpiece 9 to be connected to the water in the filtered water reservoir. When this gravity flow water filtration system is carried in a backpack, the drinking tube 8 and mouthpiece 9 allow the person carrying the backpack to drink water from the filtered water reservoir.

Figure 2:
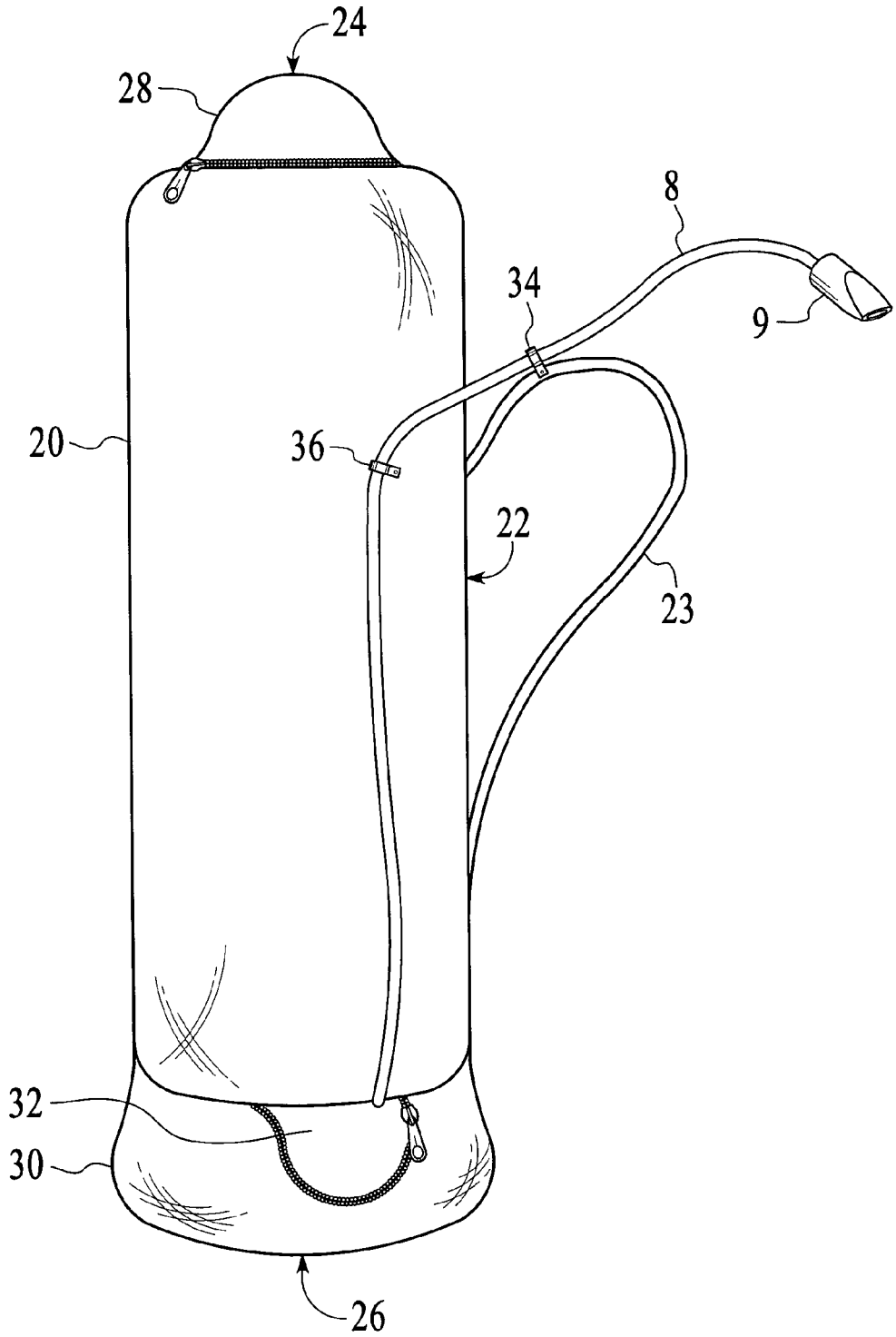
FIG. 2 is a side view of the backpack incorporating a gravity flow water filter.

FIG. 2 depicts a side view of the backpack with compartments for the gravity flow water filtration system. The backpack 20 has a strap side 22 that attaches to the shoulder straps 23. The top side 24 of the backpack is the upper side of the backpack while it is being carried by the shoulder straps. The bottom side 26 is at the bottom of the backpack while it is being carried by the shoulder straps. The top compartment 28 is designed to accommodate a fluid reservoir for untreated water. A bottom compartment 30 is designed to contain a fluid reservoir for filtered water. A water filter compartment 32 is designed to contain a water filter. A drinking tube 8 conveys the water from the filtered water reservoir to the mouthpiece 9 from which the person wearing the backpack can drink. The drinking tube 8 is secured to the backpack 20 at points 34 and 36.

Figure 3:
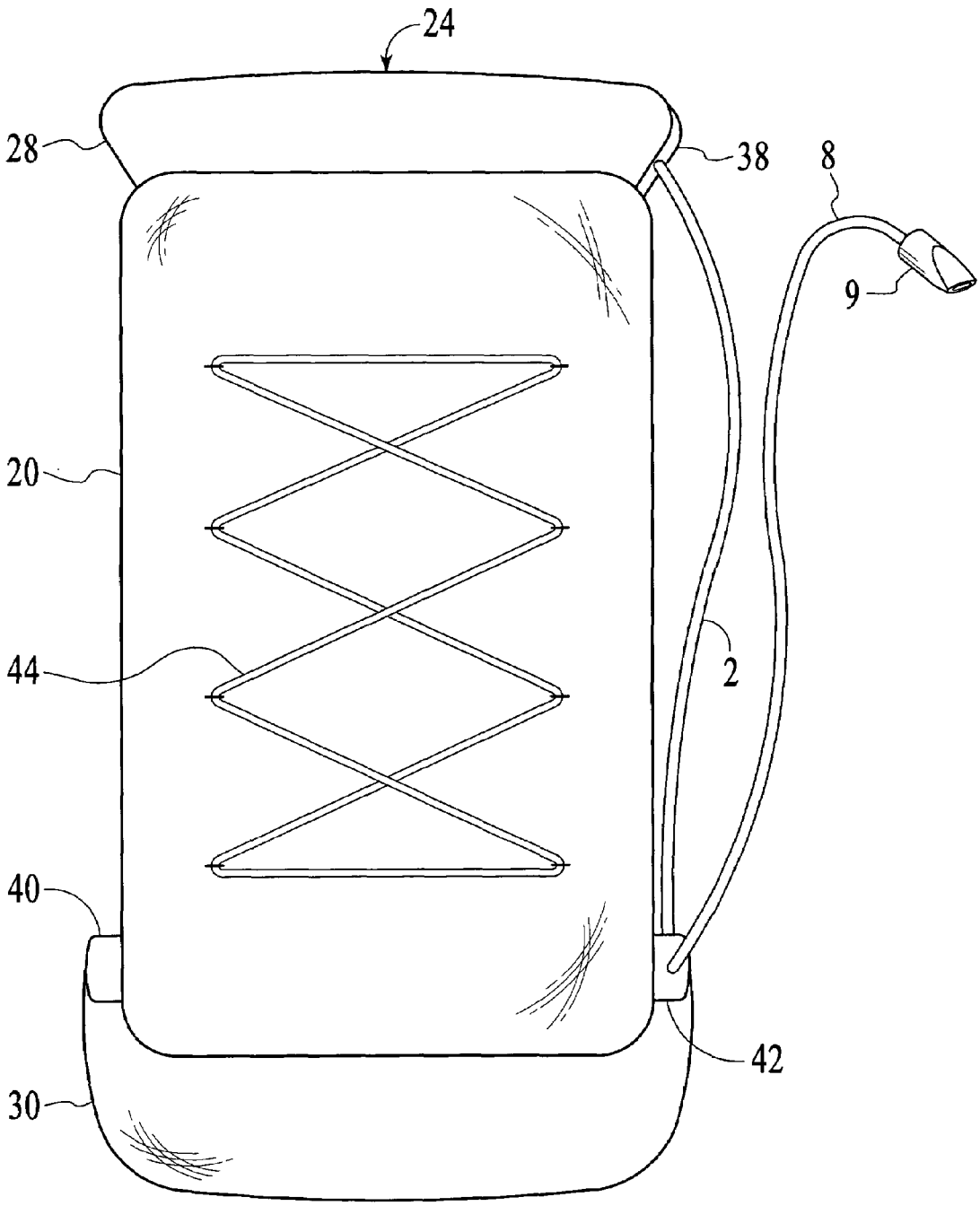
FIG. 3 is a back view of the backpack incorporating a gravity flow water filter.

FIG. 3 depicts a back view of the backpack 20, facing the side opposite the strap side. The top compartment 28 and the bottom compartment 30 have their longest dimensions in the direction parallel to the intersection of the top side 24 and the strap side 22. The top compartment has an opening 38 at the end of its longest dimension. The bottom compartment 30 has openings 40 and 42 at the ends of its longest dimension. The openings 40 and 42 are closed with elastic. The elastic closures to openings 40 and 42 allow the person wearing the backpack to insert and remove items in addition to the filtered water reservoir into the bottom compartment 30 while carrying the backpack. The lacing system 44 includes one or more laces that pass through openings (e.g., eyelets), so that the system can be tightened to shrink the volume of the backpack and compress the items in the backpack. The lacing system 44 shrinks the size of the backpack in the horizontal dimension, while allowing the backpack to retain a fixed vertical dimension. Alternatively, a number of adjustable straps may be used to enable the expandable and contractible volume.

What is claimed is:

1. A backpack having an upright condition during use, said backpack comprising:

means for securement to a wearer;

a top compartment having a first fluid reservoir for untreated water, said first fluid reservoir having an outlet positioned to enable said untreated water to drain when said backpack is in said upright condition;

a central compartment for storing belongings;

a bottom compartment on a side of said central compartment opposite to said top compartment, said bottom compartment having a second fluid reservoir for filtered water, said second fluid reservoir including an inlet;

a water filtration path connecting said outlet of said first fluid reservoir to said inlet of said second fluid reservoir such that liquid in said first fluid reservoir is in a gravity-feed relationship with said second fluid reservoir via said water filtration path, said water filtration path including a water filter; and a water drinking tube connected to one of said second fluid reservoir and a portion of said water filtration path between said water filter and said second fluid reservoir, said water drinking tube having an outlet end for enabling selective extraction of said treated water.

2. The backpack of claim 1 wherein said outlet end of said water drinking tube includes a mouthpiece.

3. The backpack of claim 1 wherein said means for securement includes shoulder straps.

4. The backpack of claim 1 wherein each said top and bottom compartment has a longest dimension that is generally horizontal when said backpack is in said upright condition.

5. The backpack of claim 4 wherein said bottom compartment has openings at opposite ends of said longest dimension, said openings being sized to enable insertion of items into said bottom compartment for storage in addition to said second fluid reservoir.

6. The backpack of claim 5 wherein said openings have elastic that enables selective access therethrough.

7. The backpack of claim 1 wherein said water filter is contained in said bottom compartment.

8. The backpack of claim 1 further comprising an adjustment system for selectively expanding and contracting the volume of said central compartment in a horizontal dimension so as to generally maintain a vertical dimension while the contents of said central compartment are varied.

* * * * *